US007453208B2

(12) United States Patent
Lin et al.

(10) Patent No.: US 7,453,208 B2
(45) Date of Patent: Nov. 18, 2008

(54) BARRIER RIB STRUCTURE OF PLASMA DISPLAY PANEL

(75) Inventors: Chun-Hsu Lin, Taipei Hsien (TW); Chao-Hung Hsu, Tai-Chung Hsien (TW)

(73) Assignee: Chunghwa Picture Tubes, Ltd., Taipei (TW)

( * ) Notice: Subject to any disclaimer, the term of this patent is extended or adjusted under 35 U.S.C. 154(b) by 340 days.

(21) Appl. No.: 11/162,283

(22) Filed: Sep. 5, 2005

(65) Prior Publication Data

US 2007/0052360 A1 Mar. 8, 2007

(51) Int. Cl.
*H01K 1/18* (2006.01)

(52) U.S. Cl. ..... 313/582; 313/292; 313/238; 313/268

(58) Field of Classification Search ..... 313/582, 313/292, 238, 268
See application file for complete search history.

(56) References Cited

U.S. PATENT DOCUMENTS 4,185,229 A * 1/1980 Yoshikawa et al. ..... 315/169.4
6,411,043 B1 * 6/2002 Jeong et al. ..... 315/169.3
6,479,935 B1 11/2002 Park et al.
6,646,378 B2 11/2003 Kanda
6,853,138 B1 2/2005 Park et al.
6,965,201 B2 * 11/2005 Kimura et al. ..... 313/582
2004/0051457 A1 * 3/2004 Kimura et al. ..... 313/586

FOREIGN PATENT DOCUMENTS

KR 2005076443 A * 7/2005

* cited by examiner

*Primary Examiner*—Peter Macchiarolo
(74) *Attorney, Agent, or Firm*—Winston Hsu

(57) ABSTRACT

A barrier rib structure of plasma display panel is disclosed. The barrier rib structure includes a plurality of vertical barrier ribs arranged in parallel, a plurality of first horizontal barrier ribs connected to one side of the vertical barrier ribs, and a plurality of second horizontal barrier ribs connected to the other side of the vertical barrier ribs, in which the first horizontal barrier ribs are disposed alternately with corresponding second horizontal barrier ribs for forming a plurality of double blockade structures. Additionally, a gas passage and a plurality of electrical discharge spaces are formed between the double blockade structures.

11 Claims, 11 Drawing Sheets

BARRIER RIB STRUCTURE OF PLASMA DISPLAY PANEL

BACKGROUND OF THE INVENTION

1. Field of the Invention

The present invention relates to the barrier rib structure of a plasma display panel and a manufacturing method thereof, and more particularly, to a barrier rib structure and manufacturing method capable of improving illumination efficiency and gas exhaust of a plasma display panel.

2. Description of the Prior Art

Plasma display panels (PDPs) have been gradually applied to large sized displaying apparatuses. The light source comes from plasma, which is initiated by electrodes, to produce ultraviolet rays. When the ultraviolet rays excite different fluorescent materials, the fluorescent materials will emit visible light having different wavelengths. In general, the PDPs have advantages of thin and lightweight design, large display size, and wide viewing angle over the cathode ray tubes (CRTs) that have been mainly employed as display devices. Therefore, PDPs are currently very popular.

In general, the barrier rib structure of conventional PDPs is stripe structure. Nevertheless, the stripe structure often causes address electrodes to result in a global breakdown, and due to smaller area capable of applying a fluorescent layer, the overall brightness of the PDPs is greatly reduced. In order to prevent the global breakdown and increase the brightness of PDPs, a closed type barrier rib structure has been developed by the industry.

Please refer to FIG. 1. FIG. 1 is a schematic diagram of a closed type barrier rib structure 12 of a PDP according to the prior art. As shown in FIG. 1, a closed type barrier rib structure 12 includes a plurality of parallel arranged vertical barrier ribs 14 and a plurality of parallel arranged horizontal barrier ribs 16, in which the vertical barrier ribs 14 and the horizontal barrier ribs 14 are disposed on the upper surface of a bottom substrate 10 to form a plurality of discharge spaces 18, e.g., discharge cells. Additionally, a plurality of address electrodes 20 are arranged in parallel with each other and disposed underneath the closed type barrier ribs structure 12, such that the address electrodes 20 are utilized to perform address discharges at the location where the address electrodes 20 cross over the sustain electrodes (not shown in FIG. 1). Moreover, the bottom substrate 10 also includes a dielectric layer 24 formed on top of the bottom substrate 10 and the address electrodes 20.

Nevertheless, after the bottom substrate 10 is tightly bound to an upper substrate (not shown), the gas trapped between the substrates is only able to circulate within the small gap (approximately 5 microns) between the upper substrate and the closed barrier rib structure 12. Consequently, performing a exhausting process on the discharge space 18 formed by the vertical barrier ribs 14 and the horizontal barrier ribs 16 will be much more difficult and will result in problems such as reduction of the speed of gas exhaust and incomplete exhaust. Moreover, the sealing process of inert gases will also become difficult and will ultimately affect the purity of the gas and reduce the life expectancy of the PDPs.

SUMMARY OF THE INVENTION

It is therefore an objective of the present invention to provide a barrier rib structure of a plasma display panel and a fabricating method thereof for solving the above-mentioned problems.

According to the present invention, a barrier rib structure of a plasma display panel (PDP) comprises: a plurality of parallel arranged vertical barrier ribs, wherein a first distance is generated between any two vertical barrier ribs adjacent to each other; a plurality of parallel arranged first horizontal barrier ribs having a first length, wherein the first horizontal barrier ribs are connected to one side of the vertical barrier ribs; a plurality of parallel arranged second horizontal barrier ribs having a second length, wherein the second horizontal barrier ribs are connected to the other side of the vertical barrier ribs, and disposed alternately with the corresponding first horizontal barrier ribs for forming a plurality of double blockade structures, wherein the gap between each first horizontal barrier rib and each second horizontal barrier rib of the double blockade structure comprises a gas passage; and a plurality of electrical discharge spaces formed between the double blockade structures and the vertical barrier ribs.

Additionally, the present invention also provides a method of fabricating the barrier rib structure of a plasma display, the method comprising: providing a substrate; providing a paste over the surface of the substrate for forming a barrier rib pattern, wherein the barrier rib pattern comprises a plurality of parallel arranged vertical barrier ribs, a plurality of parallel arranged first horizontal barrier ribs connected to one side of the vertical barrier ribs and a plurality of parallel arranged second horizontal barrier ribs connected to the other side of the vertical barrier ribs, wherein the first horizontal barrier ribs and the corresponding second horizontal barrier ribs are disposed alternately for forming a plurality of double blockade structures, and performing a firing process for firing the barrier rib patterns.

By utilizing a double blockade structure and vertical barrier ribs to form an electrical discharge space, the present invention is able to provide enough exhausting passage to improve problems such as slow exhaust, incomplete exhaust, difference in the degree of purity of the gas being sucked inside, and electrical discharge instability, thereby extending the life expectancy of the plasma display panel. Moreover, the double blockade structure of the present invention is able to effectively reduce the interference between electrical discharge space and prevent the global breakdown phenomenon. Also, the method of fabricating the barrier rib structure according to the present invention can also be carried out by utilizing existing fabrication processes, hence no extra step is required.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
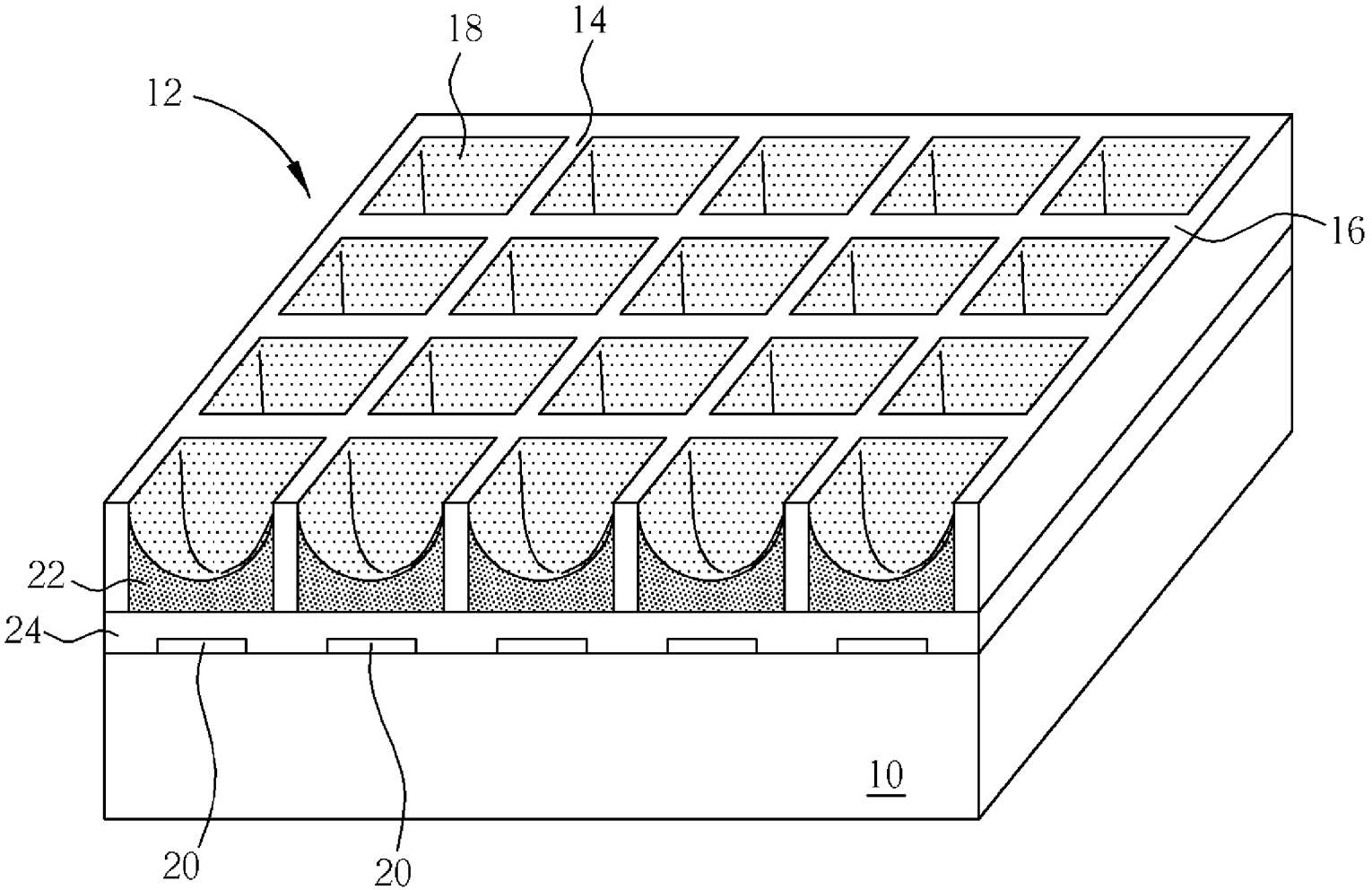
Fig. 1 Prior Art
FIG. 1 is a schematic diagram of a closed type barrier rib structure of plasma display panel according to the prior art.
Figure 2:
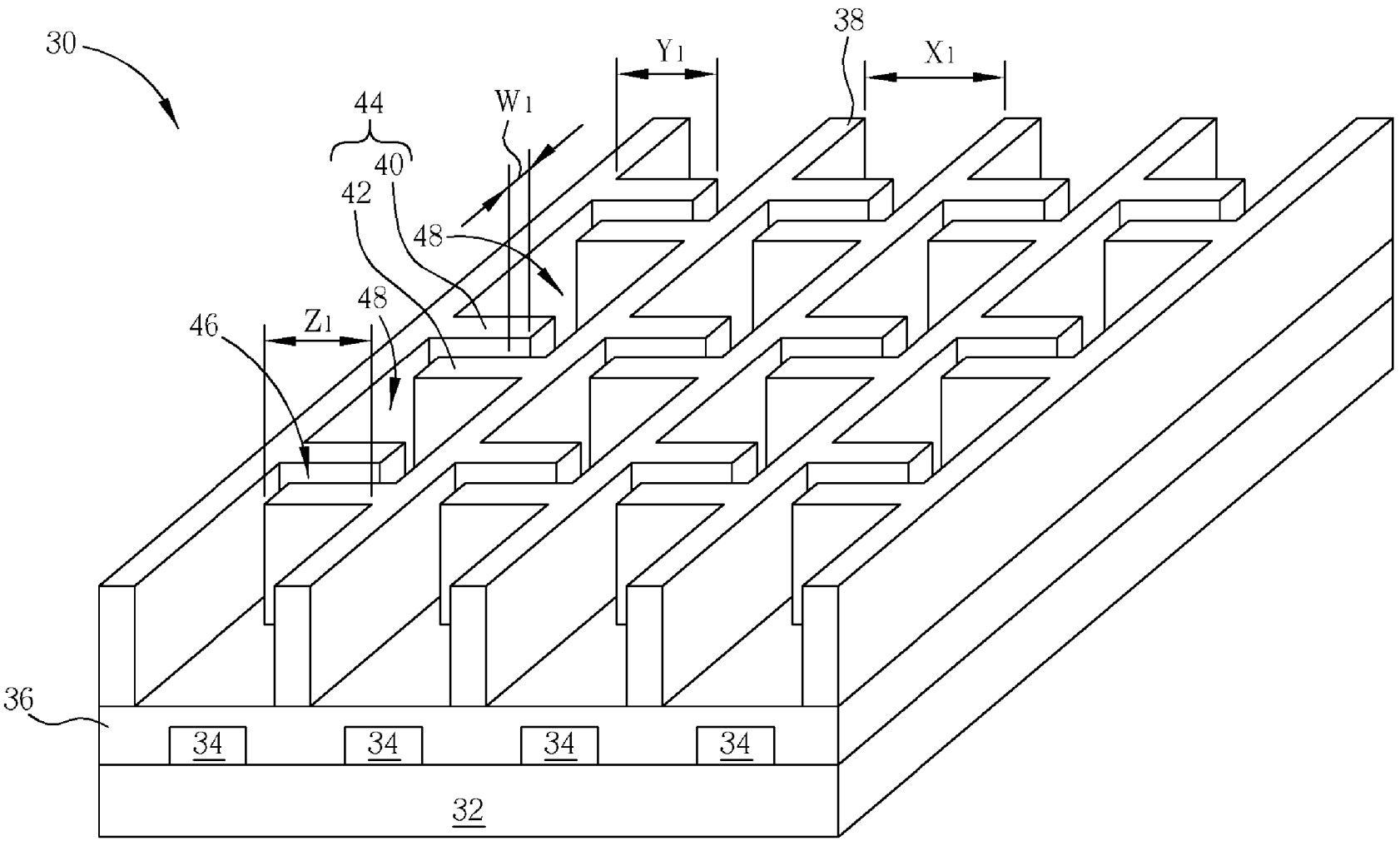
FIG. 2 is a three dimensional diagram showing the barrier rib structure of a plasma display panel according to the first embodiment of the present invention.
Figure 3:
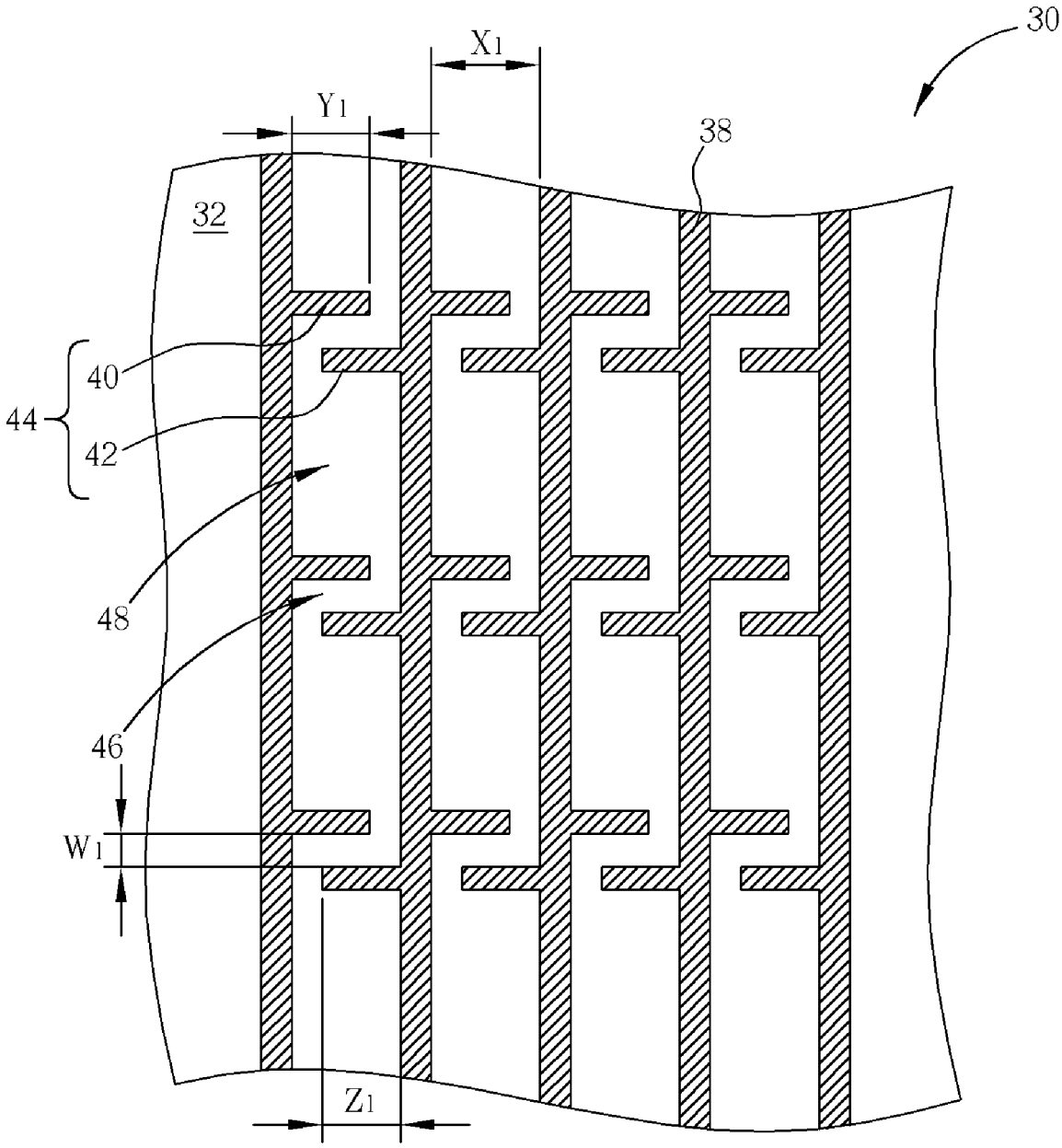
FIG. 3 is a top-view diagram of the barrier rib structure according to the first embodiment of the present invention.

Please refer to FIG. 2 and FIG. 3. FIG. 2 is a three dimensional diagram showing the barrier rib structure 30 of a plasma display panel according to the first embodiment of the present invention and FIG. 3 is a top-view diagram of the barrier rib structure 30 according to the first embodiment of the present invention. As shown in FIG. 2 and FIG. 3, the barrier rib structure 30 is formed above the upper surface of a bottom substrate 32, in which the bottom substrate 32 includes a plurality of parallel arranged vertical barrier ribs 38 and a plurality of alternately disposed first horizontal barrier ribs 40 and second horizontal barrier ribs 42. The upper surface of the bottom substrate 32 also includes a plurality of address electrodes 34 arranged in parallel and a dielectric layer 36 disposed above the address electrodes 34 and the upper surface of the bottom substrate 32. Preferably, the bottom substrate 32 is composed of transparent or non-transparent rigid materials such as glass or quartz, and each address electrode 34 is parallel with respect to the vertical barrier ribs 38 and is disposed in the center of any two vertical barrier ribs 38 adjacent to each other.

As described above, the barrier rib structure 30 of the first embodiment of the present invention includes the plurality of vertical barrier ribs 38 arranged in parallel, such that a first distance X1 is generated between two vertical barrier ribs 38 adjacent to each other. Additionally, the plurality of first horizontal barrier ribs 40 arranged in parallel is connected to one side of the vertical barrier ribs 38, such as the right side, the plurality of second horizontal barrier ribs 42 is connected to the other side of the vertical barrier ribs 38, such as the left side, and each first horizontal barrier rib 40 is disposed alternately with corresponding second horizontal barrier ribs 42 to form a plurality of double blockade structures 44. The first horizontal barrier ribs 40 include a first length Y1 and the second horizontal barrier ribs 42 include a second length Z1, and the sum of the first length Y1 and the second length Z1 is greater than the first distance X1 for preventing the global breakdown phenomenon of the prior art. Moreover, a second distance W1 is generated between the first horizontal barrier rib 40 and the second horizontal barrier ribs 42 to form a gas passage 46, in which the second distance W1 is usually greater than 10 μm for facilitating the gas exhausting process performed afterwards.

Preferably, a plurality of electrical discharge spaces 48 is formed by enclosing the barrier rib structure 30 and the vertical barrier ribs 38 via the double blockade structure 44. Hence, the advantage of having a greater fluorescent powder coating area from the conventional closed barrier rib structure can be well maintained. Additionally, by utilizing the double blockade structure 44 to isolate the electrical discharge spaces 48, the present invention is able to effectively decrease the interference between any electrical discharge spaces 48 adjacent to each other, thereby minimizing accidents caused by electrical discharges.

Figure 4:
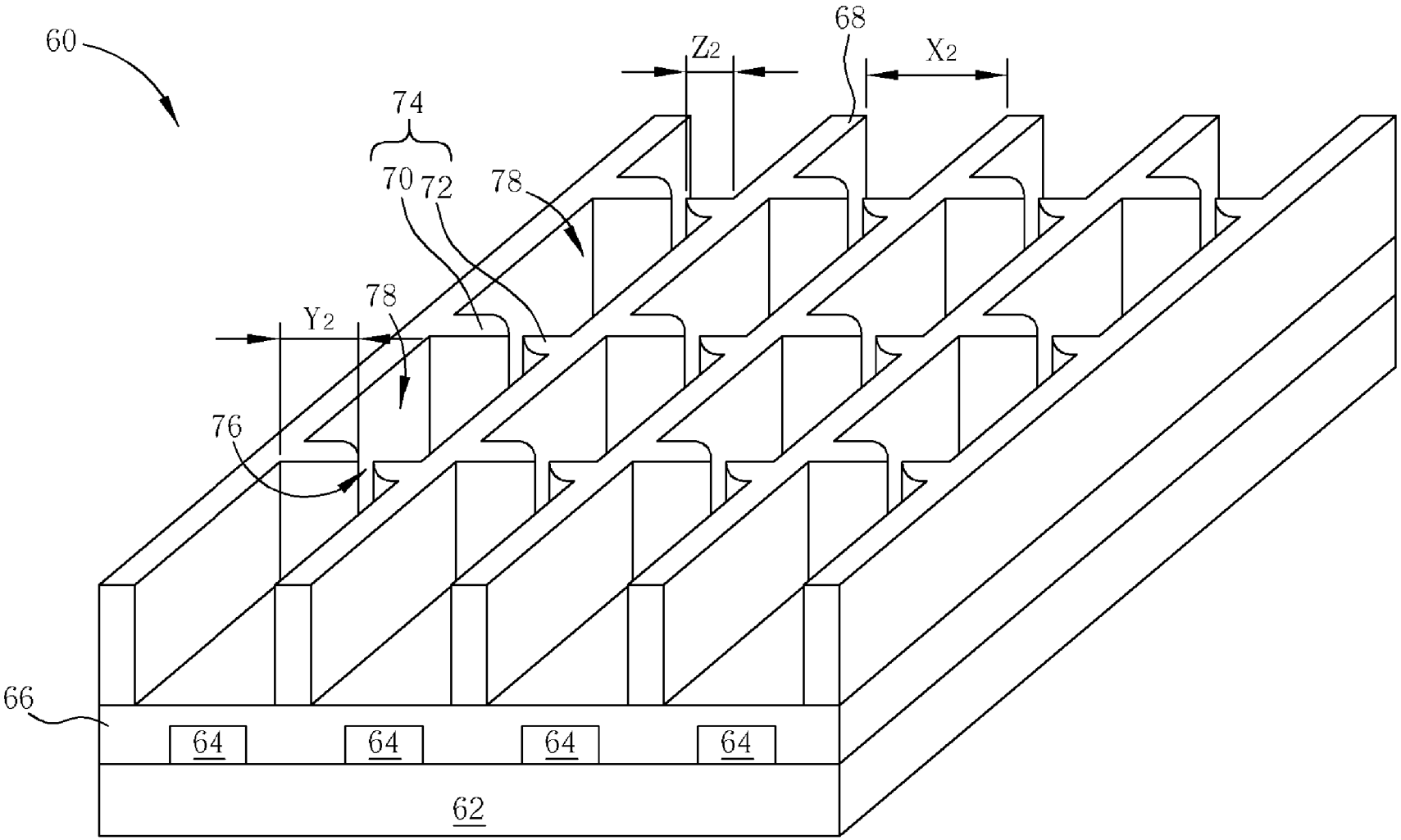
FIG. 4 is a three dimensional diagram showing the barrier rib structure of a plasma display panel according to the second embodiment of the present invention.
Figure 5:
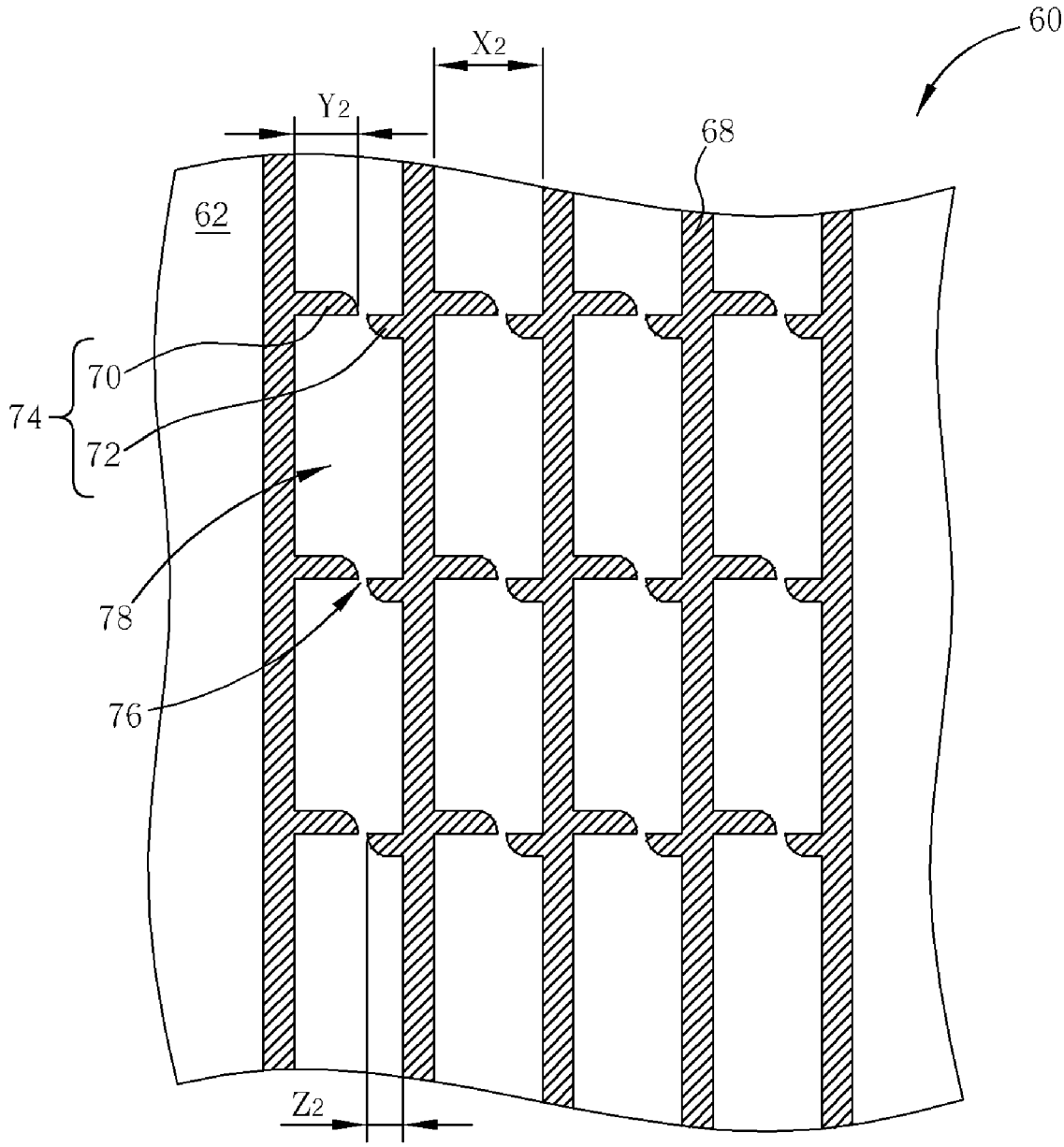
FIG. 5 is a top-view diagram of the barrier rib structure according to the second embodiment of the present invention.

Please refer to FIG. 4 and FIG. 5. FIG. 4 is a three dimensional diagram showing the barrier rib structure 60 of a plasma display panel according to the second embodiment of the present invention and FIG. 5 is a top-view diagram of the barrier rib structure 60 according to the second embodiment of the present invention. In contrast to the first embodiment, the sum of the length of the first horizontal barrier rib and the second horizontal barrier rib of the present embodiment is less than the spacing distance between the vertical barrier ribs and the vertical distance between the first horizontal barrier rib and the second horizontal barrier rib is zero, such that a larger discharge space and fluorescent powder coating area can be obtained. As shown in FIG. 4 and FIG. 5, the barrier rib structure 60 is formed above the upper surface of a bottom substrate 62, in which the bottom substrate 62 includes a plurality of vertical barrier ribs 68 arranged in parallel and a plurality of alternately disposed first horizontal barrier ribs 70 and second horizontal barrier ribs 72. The upper surface of the bottom substrate 62 also includes a plurality of address electrodes 64 arranged in parallel and a dielectric layer 66 disposed above the address electrodes 64 and the upper surface of the bottom substrate 62. Preferably, the bottom substrate 62 is composed of transparent or non-transparent rigid materials, and each address electrode 64 is parallel with respect to the vertical barrier ribs 68 and is disposed in the center of any two vertical barrier ribs 68 adjacent to each other.

Similarly, a first distance X2 is generated between two vertical barrier ribs 68 adjacent to each other, the plurality of first horizontal barrier ribs 70 arranged in parallel is connected to one side of the vertical barrier ribs 68, such as the right side, the plurality of second horizontal barrier ribs 72 is connected to the other side of the vertical barrier ribs 68, such as the left side, and each first horizontal barrier rib 70 is disposed alternately with corresponding second horizontal barrier ribs 72 to form a plurality of double blockade structures 74. The first horizontal barrier ribs 70 also include a first length Y2 and the second horizontal barrier ribs 72 include a second length Z2, and the sum of the first length Y2 and the second length Z2 is less than the first distance X2 to form a gas passage 76, thereby facilitating the gas exhausting process performed afterwards. Moreover, the first length Y2 is different from the second length Z2, such that the gas passage 76 is not formed directly above the address electrodes 64, thereby effectively preventing the global breakdown phenomenon of the prior art.

Preferably, a plurality of electrical discharge spaces 78 is formed by enclosing the barrier rib structure 60 and the vertical barrier ribs 68 via the double blockade structure 74. Hence, the advantage of having greater fluorescent powder coating area from the conventional closed barrier rib structure can be well maintained. Additionally, by utilizing the double blockade structure 74 to isolate the electrical discharge spaces 78, the present invention is able to effectively decrease the interference between any electrical discharge spaces 78 adjacent to each other, thereby minimizing accidents caused by electrical discharges.

Figure 6:
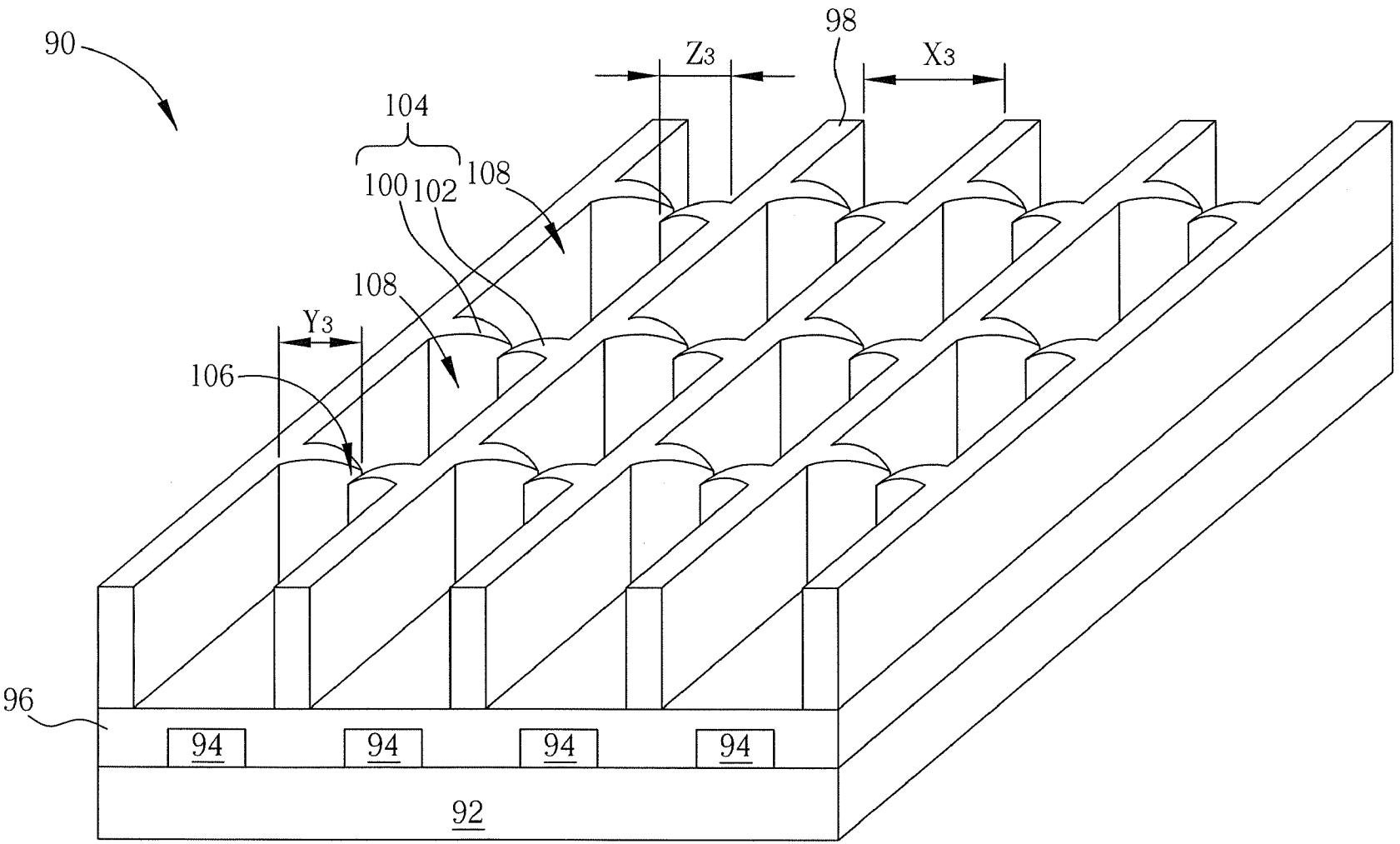
FIG. 6 is a three dimensional diagram showing the barrier rib structure of a plasma display panel according to the third embodiment of the present invention.
Figure 7:
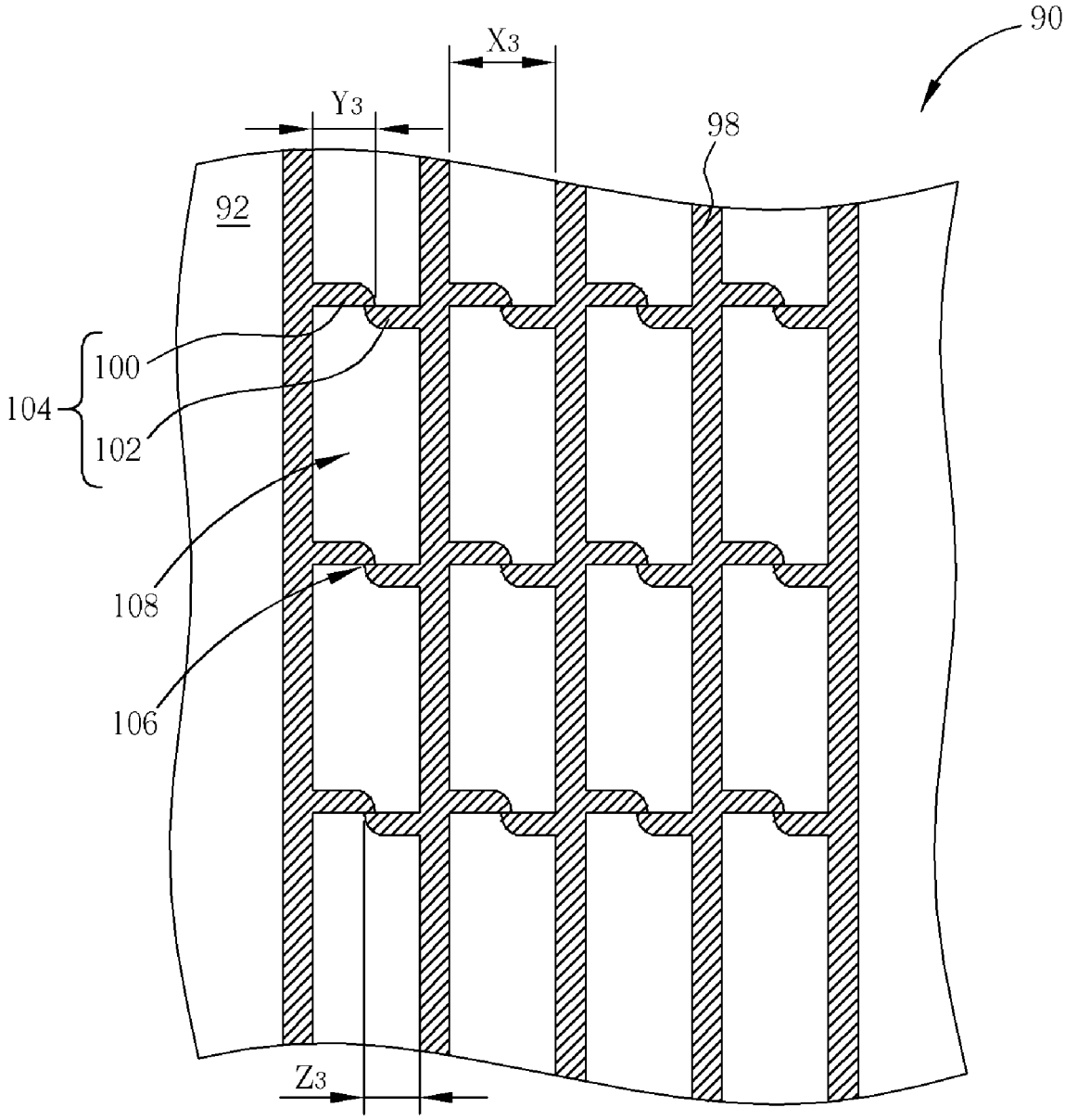
FIG. 7 is a top-view diagram of the barrier rib structure according to the third embodiment of the present invention.

Please refer to FIG. 6 and FIG. 7. FIG. 6 is a three dimensional diagram showing the barrier rib structure 90 of a plasma display panel according to the third embodiment of the present invention and FIG. 7 is a top-view diagram of the barrier rib structure 90 according to the third embodiment of the present invention. In contrast to the first embodiment, the first horizontal barrier ribs are connected to the second horizontal barrier ribs, such that a gas passage is created by utilizing the height difference of the contact point between the two horizontal barrier ribs.

As shown in FIG. 6 and FIG. 7, the barrier rib structure 90 is formed above the upper surface of a bottom substrate 92, in which the bottom substrate 92 includes a plurality of vertical barrier ribs 98 arranged in parallel and a plurality of alternately disposed first horizontal barrier ribs 100 and second horizontal barrier ribs 102. The upper surface of the bottom substrate 92 also includes a plurality of address electrodes 94 arranged in parallel and a dielectric layer 96 disposed above the address electrodes 94 and the upper surface of the bottom substrate 92. Preferably, the bottom substrate 92 is composed of transparent or non-transparent rigid materials such as glass or quartz, and each address electrode 94 is disposed in the center of any two vertical barrier ribs 98 adjacent to each other.

Similarly, a first distance X3 is generated between two vertical barrier ribs 98 adjacent to each other, the plurality of first horizontal barrier ribs 100 arranged in parallel is connected to the right side of the vertical barrier ribs 98, the plurality of second horizontal barrier ribs 102 is connected to the left side of the vertical barrier ribs 98, and each first horizontal barrier rib 100 is disposed alternately with corresponding second horizontal barrier rib 102 to form a plurality of double blockade structures 104. The first horizontal barrier ribs 100 also include a first length Y3 and the second horizontal barrier ribs 102 include a second length Z3. The sum of the first length Y3 and the second length Z3 is greater than the first distance X3 and the first horizontal barrier ribs 100 are connected to the second horizontal barrier ribs 102. Preferably, the height of the first horizontal barrier ribs 100 and the second horizontal barrier ribs 102 is gradually decreased from the end connected to the vertical barrier rib 98 to the other end, such that a gas passage 106 is created at the point where two horizontal barrier ribs are interconnected, thereby facilitating the gas exhausting process performed afterwards. Moreover, the first length Y3 is different from the second length Z3, such that the gas passage 106 is not formed directly above the address electrodes 94, thereby effectively preventing the global breakdown phenomenon of the prior art.

Preferably, a plurality of electrical discharge spaces 108 is formed by enclosing the barrier rib structure 90 and the vertical barrier ribs 98 via the double blockade structure 104. Hence, the advantage of having greater fluorescent powder coating area from the conventional closed barrier rib structure can be well maintained. Additionally, by utilizing the double blockade structure 104 to isolate the electrical discharge spaces 108, the present invention is able to effectively decrease the interference between any electrical discharge spaces 108 adjacent to each other, thereby minimizing accidents caused by electrical discharges.

Essentially, the method fabricating the barrier rib structure 60 and barrier rib structure 90 from the second and third embodiment of the present invention includes the following steps. First, a substrate is provided, and a paste is coated over the surface of the substrate to form a barrier rib pattern after the paste is dried, in which the barrier rib pattern includes a plurality of vertical barrier ribs arranged in parallel, a plurality of parallel arranged first horizontal barrier ribs connected to one side of the vertical barrier ribs and a plurality of parallel arranged second horizontal barrier ribs connected to the other side of the vertical barrier ribs, such that the first horizontal barrier ribs and the corresponding second horizontal barrier ribs are disposed alternately to form a plurality of double blockade structures. Next, a firing process is performed to fire the barrier rib patterns, in which the first horizontal barrier ribs and the second horizontal barrier ribs of the double blockade structure are interconnected. Preferably, the width of the first horizontal barrier ribs and the second horizontal barrier ribs will gradually decrease from the end connected to the vertical barrier ribs to the other end and after the firing process, and the first horizontal barrier ribs and the second horizontal barrier ribs will contract, such that the contraction is inversely proportional to the width of the barrier ribs to create the gas passage between the first horizontal barrier ribs and the second horizontal barrier ribs, as shown in FIG. 4 and FIG. 5. Alternatively, the height of the first horizontal barrier ribs and the second horizontal barrier ribs can be gradually decreased from the end connected to the vertical barrier ribs to the other end to form the gas passage shown in FIG. 6 and FIG. 7.

Figure 8:
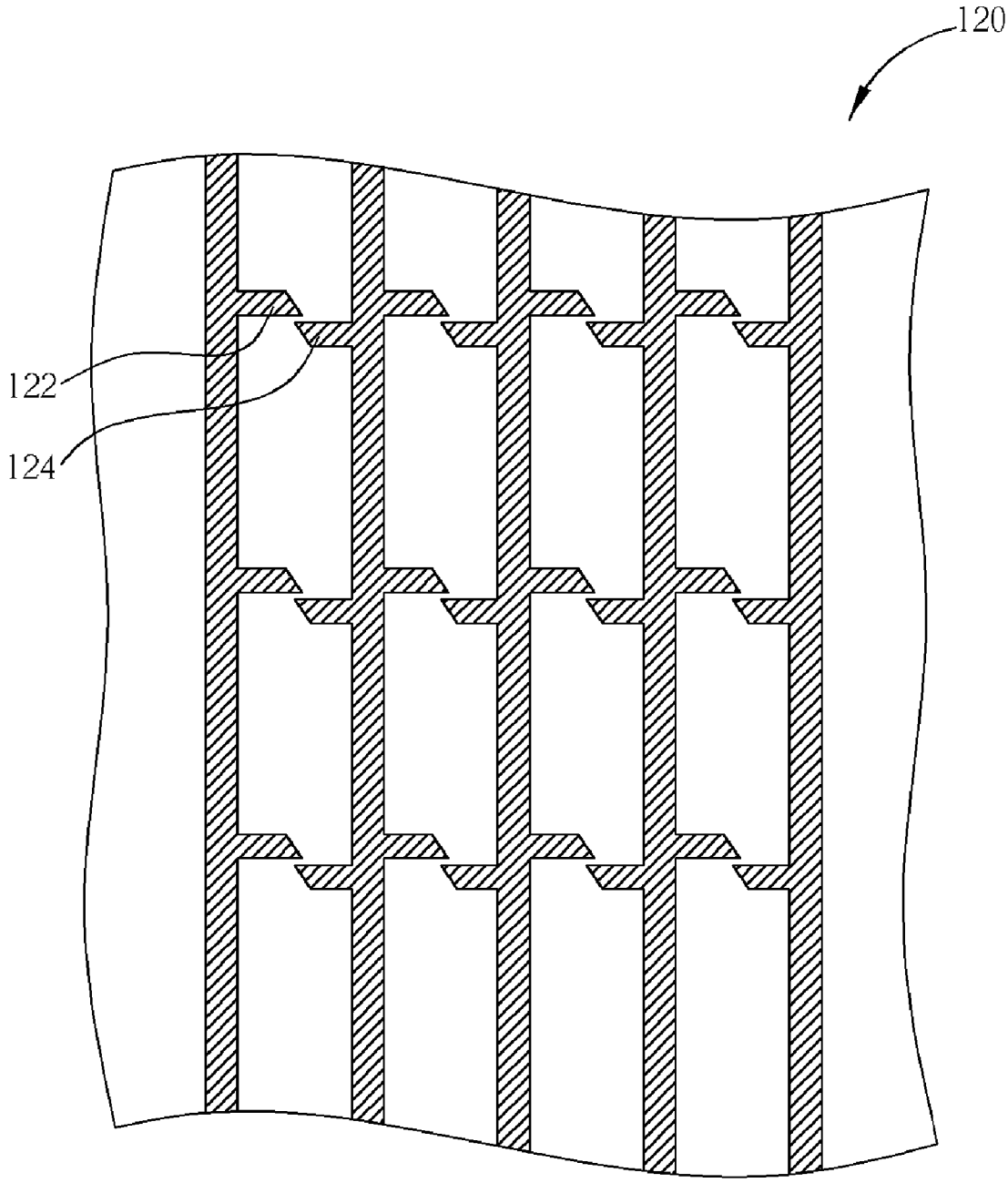
FIG. 8 through FIG. 11 are perspective diagrams showing the barrier rib structure of a plasma display panel according to other embodiments of the present invention.
Figure 9:
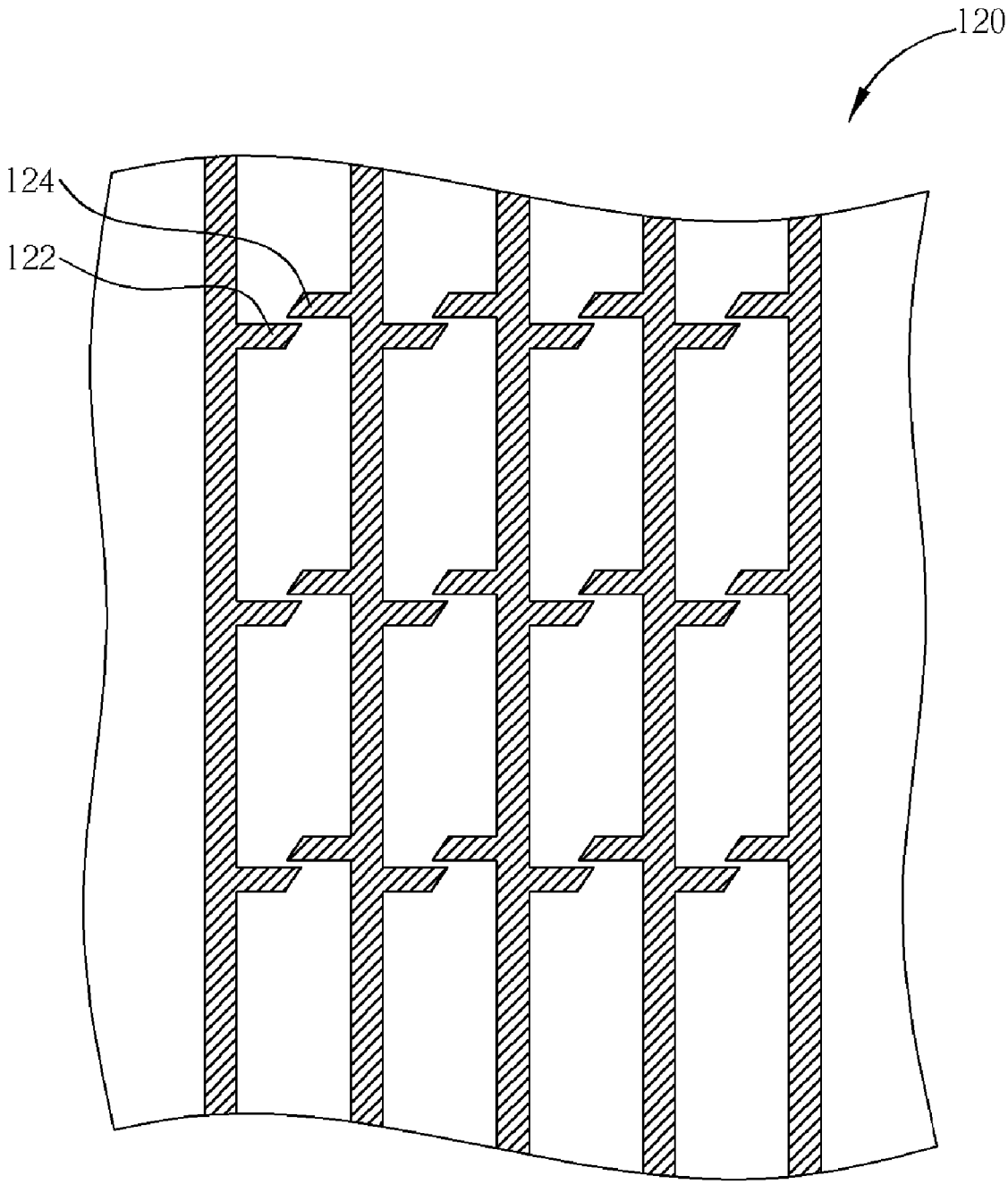

Please refer to FIG. 8 through FIG. 11. FIG. 8 through FIG. 11 are perspective diagrams showing the barrier rib structure 120, 130, and 140 of a plasma display panel according to other embodiments of the present invention. As shown in FIG. 8 and FIG. 9, the barrier rib structure 120 is structurally analogous to the barrier rib structure 60 from the second embodiment and the barrier rib structure 90 from the third embodiment, such that a gas passage (not shown) is formed by utilizing the gap or height difference between the first horizontal barrier ribs 122 and the second horizontal barrier ribs 124. By disposing the structures symmetrically, the strength of the barrier rib structure 120 is much better than that the barrier rib structures 60 and 90.

Figure 10:
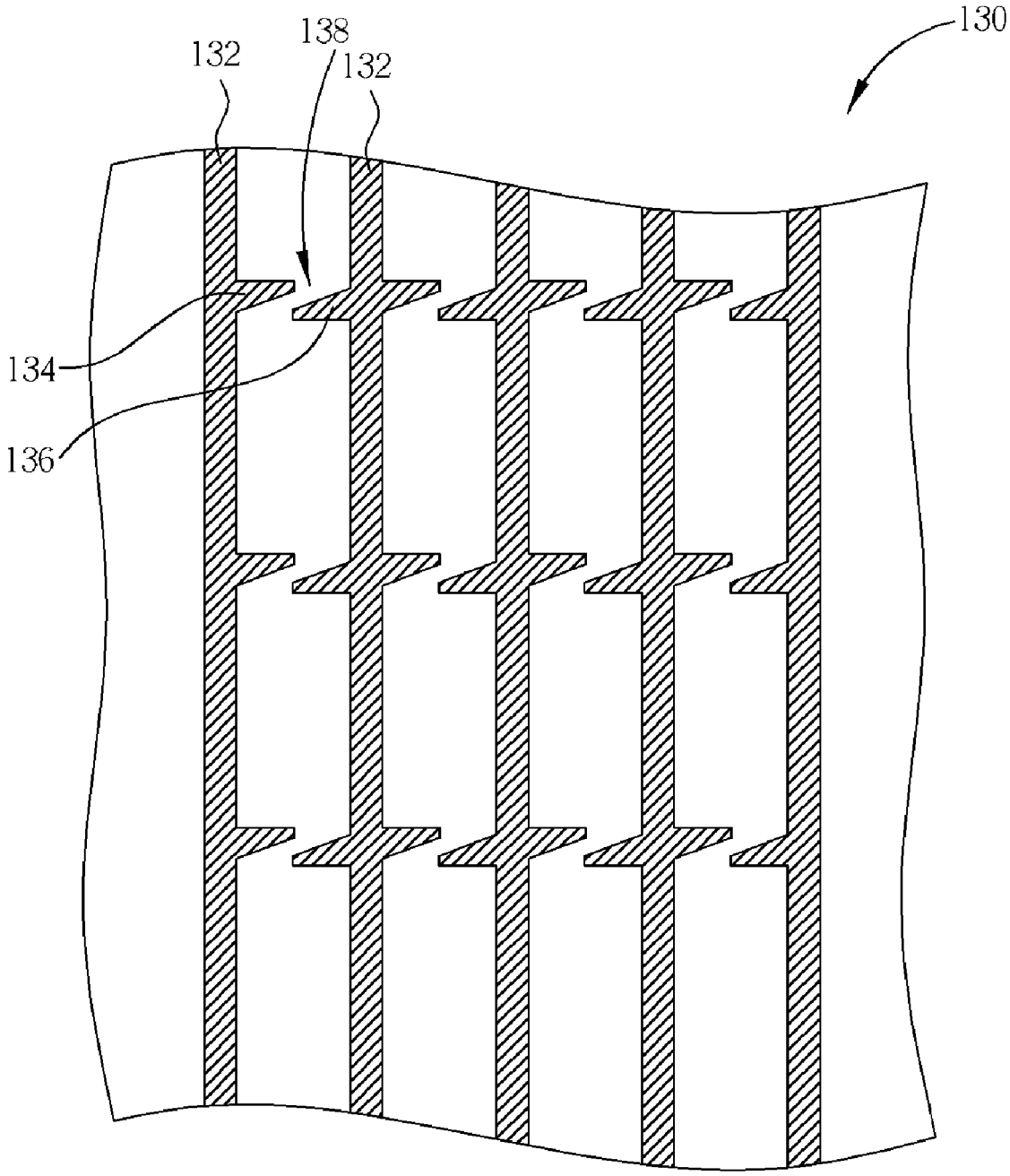

Additionally, an electrical discharge space can be further added into the barrier rib structure 130 and barrier rib structure 140. As shown in FIG. 10, the barrier rib structure 130 includes a plurality of parallel arranged vertical barrier ribs 132, a plurality of parallel arranged first horizontal barrier ribs 134, and a plurality of parallel arranged second horizontal barrier ribs 136, in which the sum of the length of the first horizontal barrier ribs 134 and the length of the second horizontal barrier rib 136 is greater than the gap distance between any two vertical barrier ribs 132. Furthermore, the width of each first horizontal barrier rib 134 and each second horizontal barrier rib 136 is gradually decreased from the end connected to the vertical barrier ribs 132 to the other end, thereby forming a gas passage 138.

Figure 11:
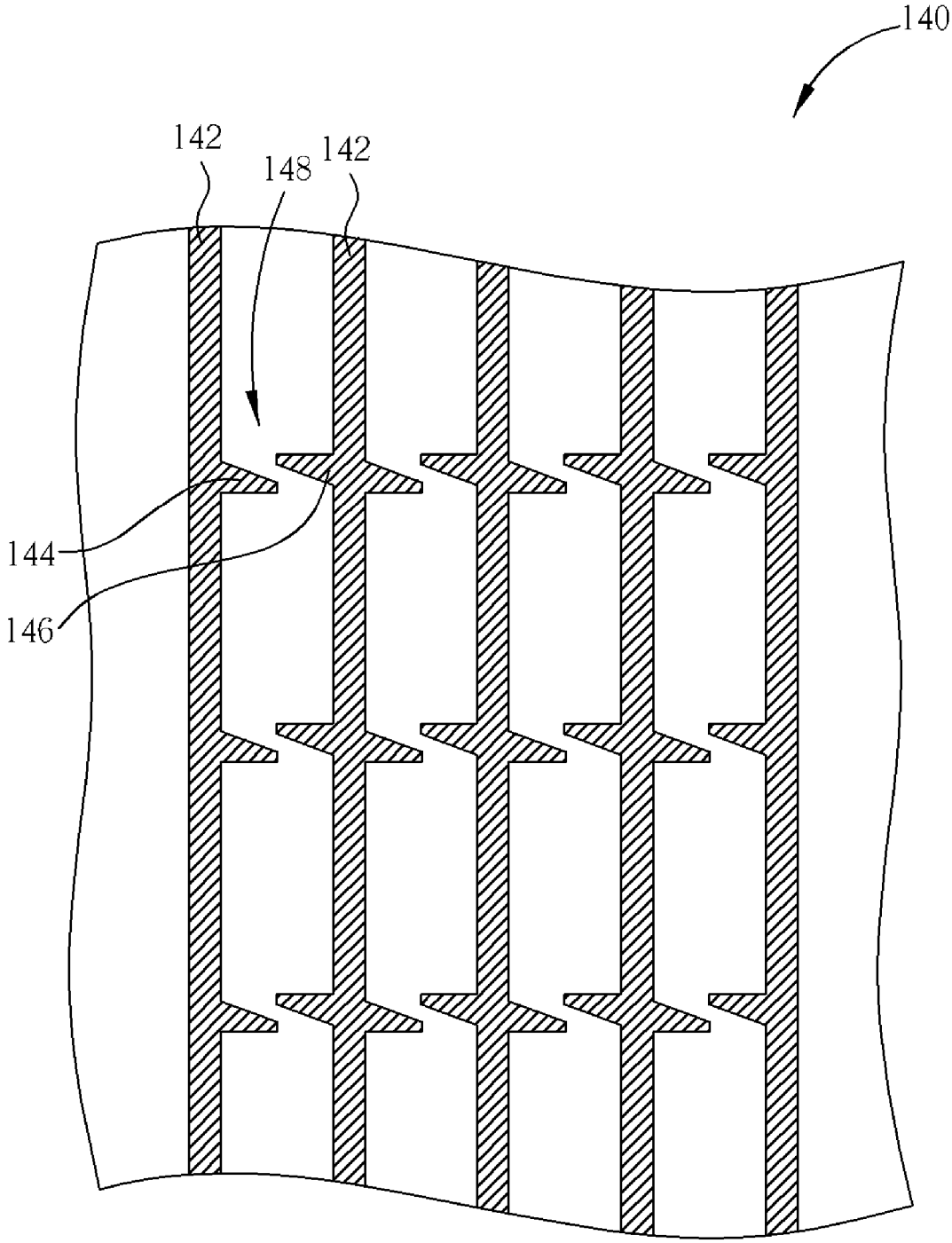

As shown in FIG. 11, the barrier rib structure 140 includes a plurality of parallel arranged vertical barrier ribs 142, a plurality of parallel arranged first horizontal barrier ribs 144, and a plurality of parallel arranged second horizontal barrier ribs 146, in which the sum of the length of the first horizontal barrier ribs 144 and the length of the second horizontal barrier rib 146 is greater than the gap distance between any two vertical barrier ribs 142. Furthermore, the width of each first horizontal barrier rib 144 and each second horizontal barrier rib 146 is gradually decreased from the end connected to the vertical barrier ribs 142 to the other end, thereby forming a gas passage 148.

In contrast to the conventional barrier rib structure, the barrier rib structure of the plasma display panel according to the present invention utilizes a double blockade structure and vertical barrier ribs to form an electrical discharge space, such that enough exhausting passage can be provided to improve problems such as slow exhaust, incomplete exhaust, difference in the degree of purity of the gas being sucked inside, and electrical discharge instability, thereby extending the life expectancy of the plasma display panel. Moreover, the double blockade structure of the present invention is able to effectively reduce the interference between electrical discharge space and prevent the global breakdown phenomenon. Also, the method of fabricating the barrier rib structure according to the present invention can also be carried out by utilizing existing fabrication processes, hence no extra step is required.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A barrier rib structure of plasma display panel (PDP) comprising:

a plurality of parallel arranged vertical barrier ribs, wherein a first distance is generated between any two vertical barrier ribs adjacent to each other;

a plurality of parallel arranged first horizontal barrier ribs having a first length, wherein the first horizontal barrier ribs are connected to one side of the vertical barrier ribs;

a plurality of parallel arranged second horizontal barrier ribs having a second length, wherein the second horizontal barrier ribs are connected to the other side of the vertical barrier ribs, and disposed alternately with the corresponding first horizontal barrier ribs for forming a plurality of double blockade structures, wherein the gap between each first horizontal barrier rib and each second horizontal barrier rib of the double blockade structure comprises a gas passage, and the height of each first horizontal barrier rib and each second horizontal barrier rib gradually decreases from the end connected to the vertical barrier ribs to another end for forming the gas passage; and a plurality of electrical discharge spaces formed between the double blockade structures and the vertical barrier ribs, wherein each of the electrical discharge-spaces are formed between two adjacent gas passages.

2. The barrier rib structure of claim 1, wherein the first length is different from the second length.

3. The barrier rib structure of claim 1, wherein the sum of the first length and the second length is greater than the first distance.

4. The barrier rib structure of claim 3, wherein a second distance is generated between each first horizontal barrier rib and each second horizontal barrier rib of the double blockade structure for forming the gas passage.

5. The barrier rib structure of claim 3, wherein the width of each first horizontal barrier rib and each second horizontal barrier rib is gradually decreased from the end connected to the vertical barrier ribs to another end for forming the gas passage.

6. The barrier rib structure of claim 1, wherein the sum of the first length and the second length is less than the first distance and a gas passage is formed between each first horizontal barrier rib and each second horizontal barrier rib of the double blockade structure.

7. The barrier rib structure of claim 6, wherein the width of each first horizontal rib and each second horizontal rib is gradually decreased from the end connected to the vertical barrier ribs to another end.

8. A method of fabricating the barrier rib structure of a plasma display, the method comprising:

providing a substrate;

providing a paste over the surface of the substrate for forming a barrier rib pattern, wherein the barrier rib pattern comprises a plurality of parallel arranged vertical barrier ribs, a plurality of parallel arranged first horizontal barrier ribs connected to one side of the vertical barrier ribs and a plurality of parallel arranged second horizontal barrier ribs connected to the other side of the vertical barrier ribs, wherein the first horizontal barrier ribs and the corresponding second horizontal barrier ribs are disposed alternately for forming a plurality of double blockade structures, wherein each of the double blockade structures comprise a gas passage and an electrical discharge space is formed between two gas passages, and the height of each first horizontal barrier rib and each second horizontal barrier rib gradually decreases from the end connected to the vertical barrier ribs to another end for forming the gas passage; and performing a firing process for firing the barrier rib patterns.

9. The method of claim 8, wherein the first horizontal barrier ribs of the double blockade structure are connected to the second horizontal barrier ribs, and the width of each first horizontal barrier rib and each second horizontal barrier rib is gradually decreased from one end connected to the vertical barrier ribs to another end.

10. The method of claim 9, wherein the firing process facilitates contraction of the first horizontal barrier ribs and the second horizontal barrier ribs for forming a first gas passage between each first horizontal barrier rib and each second horizontal barrier rib.

11. The method of claim 8, wherein the firing process facilitates contraction of the first horizontal barrier ribs and the second horizontal barrier ribs, such that the height of each first horizontal rib and each second horizontal rib is gradually decreased from the end connected to the vertical rib to another end for forming a second gas passage.

* * * * *